United States Patent [19]

Bello

[11] Patent Number: 4,582,285

[45] Date of Patent: Apr. 15, 1986

[54] COPY HOLDER

[76] Inventor: Raymond P. Bello, 20 Rock La., Yonkers, N.Y. 10701

[21] Appl. No.: 700,542

[22] Filed: Feb. 11, 1985

[51] Int. Cl.[4] ..... B41J 11/02

[52] U.S. Cl. ..... 248/442.2; 248/278; 248/454

[58] Field of Search ..... 248/442.2, 448, 441.1, 248/444.1, 445, 446, 447.1, 450, 451, 460, 463, 454, 278, 125, 295.1, 287; 312/233; 211/42; 24/115 G

[56] References Cited

U.S. PATENT DOCUMENTS

| | | | |
|---|---|---|---|
| 728,613 | 5/1903 | Price | 248/451 X |
| 794,099 | 7/1905 | Heaney | 248/442.2 |
| 1,188,675 | 6/1916 | Olive | 248/448 X |
| 1,458,457 | 6/1923 | Droz | 248/442.2 |
| 1,590,203 | 6/1926 | Olssen et al. | 248/278 X |
| 2,198,356 | 4/1940 | Unger et al. | 248/446 |
| 2,460,880 | 2/1949 | Geizer et al. | 248/278 X |
| 3,099,102 | 7/1963 | Mitsuyasu | 248/442.2 |
| 3,332,399 | 7/1967 | Patrick et al. | 248/450 X |
| 4,288,891 | 9/1981 | Boden | 24/115 G |
| 4,506,417 | 3/1985 | Hara | 24/115 G |

*Primary Examiner*—J. Franklin Foss

*Attorney, Agent, or Firm*—Howard F. Mandelbaum

[57] ABSTRACT

A copy holder used on a desk to hold work consisting of papers or other graphic materials for viewing by a typist or terminal operator has a lip for placement under a terminal or typewriter. A sentence page guide is frictionally journalled and longitudinally slidable on a cylindrical guide strip rod offset from the copy holder plate which supports the work. A swing eye rod extending from the copy holder plate is journalled in one end of a spring holder arm which is hollow and contains two inserts urged apart by an intermediate coil spring to frictionally hold the copy holder plate in position. The other end of the spring holder arm is frictionally pivotally mounted on a base.

7 Claims, 10 Drawing Figures

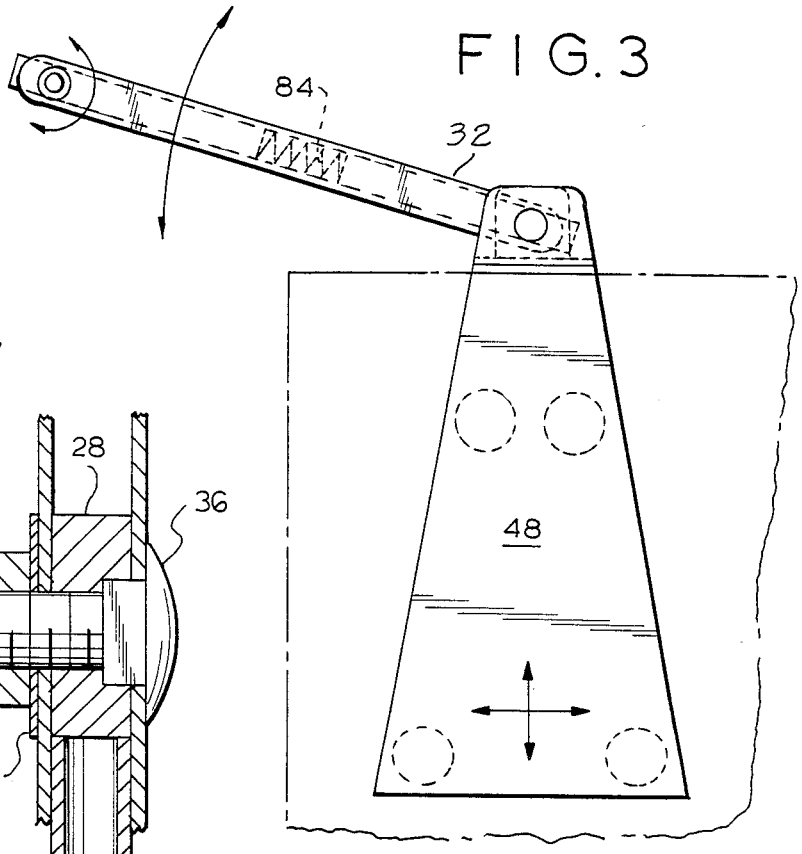
FIG. 3
FIG. 7
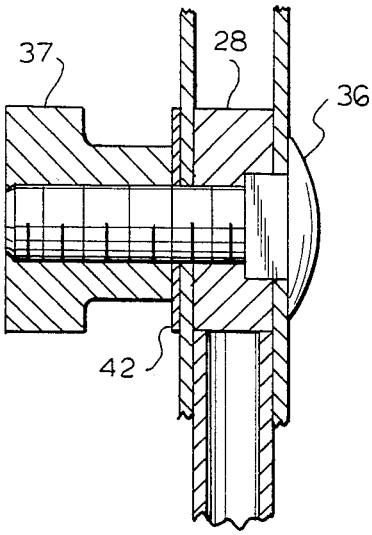
FIG. 9
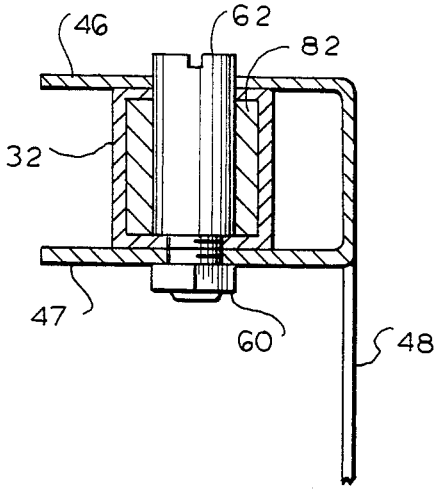
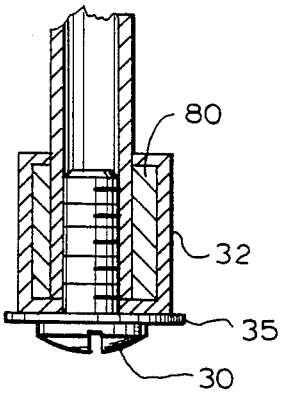
FIG. 8

FIG. 4
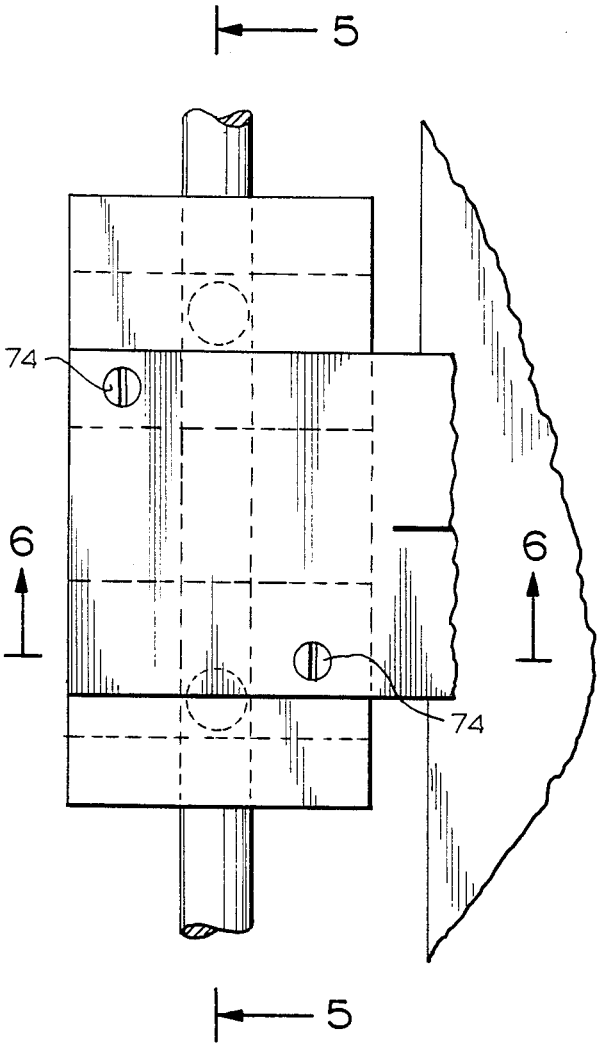
FIG. 5
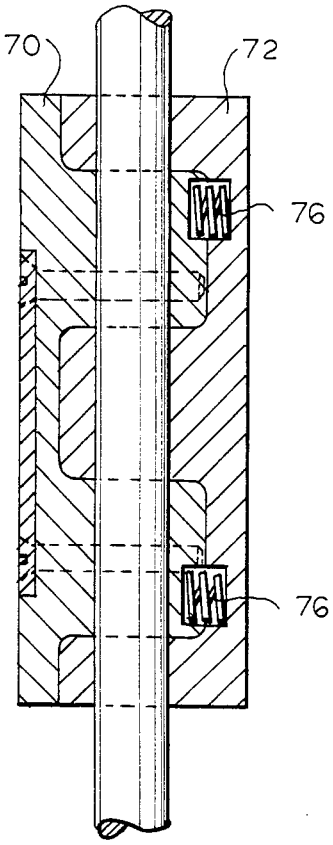
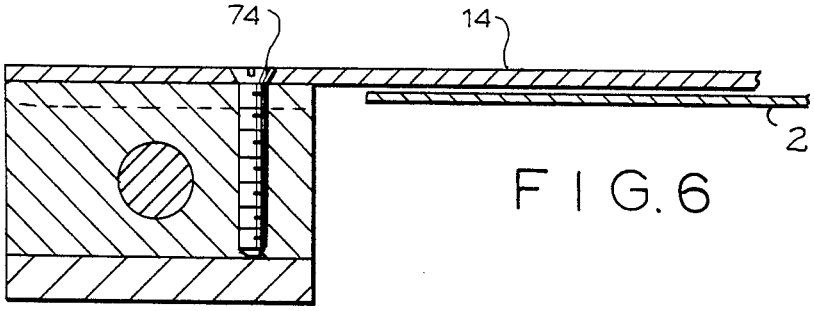
FIG. 6

COPY HOLDER

BACKGROUND OF THE INVENTION

Copy holders are known for use on a desk to hold work consisting of papers or other graphic materials for viewing by a typist or computer terminal operator. In some, swivel joints are provided to allow rotation in various planes for precise positioning of the work.

The components of prior art copy holders are generally not movable from one position to another unless a fastener is first manually released to relieve a holding tension. The copy holder is then repositioned, and finally the tensioning fastener is again tightened so that the copy support apparatus will not move. This is an awkward procedure which discourages proper positioning of the work and increases operator stress.

Some prior art copy holders also take up valuable desk space by standing on an area of the desk surface which would otherwise be put to use. Other prior art copy holders use clamps to attach the copy holder to an overhang on the edge of the desk but are not suitable for use with desks or tables which do not have an overhang.

SUMMARY OF THE INVENTION

This invention overcomes the aforementioned problems of the prior art by providing a copy holder with a base having a lip disposed in a substantially horizontal plane, a holder for receiving copy to be viewed, an arm connected to the holder and the base and maintaining the holder in a position offset from the base, at least one of the base and the holder being pivotally joined to the arm to permit relative rotation therebetween, friction means movably mounted on at least one of the arm and the pivotally connected support means and including an insert slidably disposed in the arm, the insert being urged into frictional contact, and urging means having a spring disposed between the friction means and the other of the arm and the pivotally connected support means, the friction means being urged toward the other of the arm and the pivotally connected support means for exerting a frictional force thereagainst for normally maintaining the support means in fixed position but permitting relative movement between the arm and the support means when a force greater than the frictional force exerted by the friction means is applied between the arm and the support means.

It is therefore an object of the invention to provide a support for papers, documents or other copy to be viewed adjacent a typewriter or a terminal positioned on a desk top;

Another object of the invention is to provide a support for papers, documents or other copy to be viewed which occupies substantially no desk space in addition to that used by the typewriter or terminal;

Still Another object of the invention is to provide a support for papers, documents or other copy to be viewed which can be readily positioned and repositioned with minimum effort;

A further object of the invention is to provide a support for papers, documents or other copy to be viewed which while offering flexibility and ease of positioning, is highly stable.

Other and further objects of the invention will be apparent from the following drawings and description of a preferred embodiment of the invention in which like reference numerals are used to indicate like parts in the various views.

DESCRIPTION OF THE DRAWINGS

FIG. 3 is a sectional view of the preferred embodiment of the apparatus of the invention taken through line 3—3 of FIG. 1.

FIG. 4 is an enlarged fragmentary view of a part of the apparatus of the invention;

FIG. 5 is a sectional fragmentary view of a part of the apparatus of the invention taken through line 5—5 of FIG. 4.

FIG. 6 is a sectional fragmentary view of a part of the apparatus of the invention taken through line 6—6 of FIG. 5.

FIG. 7 is a sectional view of a part of the apparatus of the invention taken through line 7—7 of FIG. 2.

FIG. 8 is a sectional view of a part of the apparatus of the invention taken through line 8—8 of FIG. 2.

FIG. 9 is a sectional view of a part of the apparatus of the invention taken through line 9—9 of FIG. 1.

DESCRIPTION OF THE PREFERRED EMBODIMENT

Figure 1:
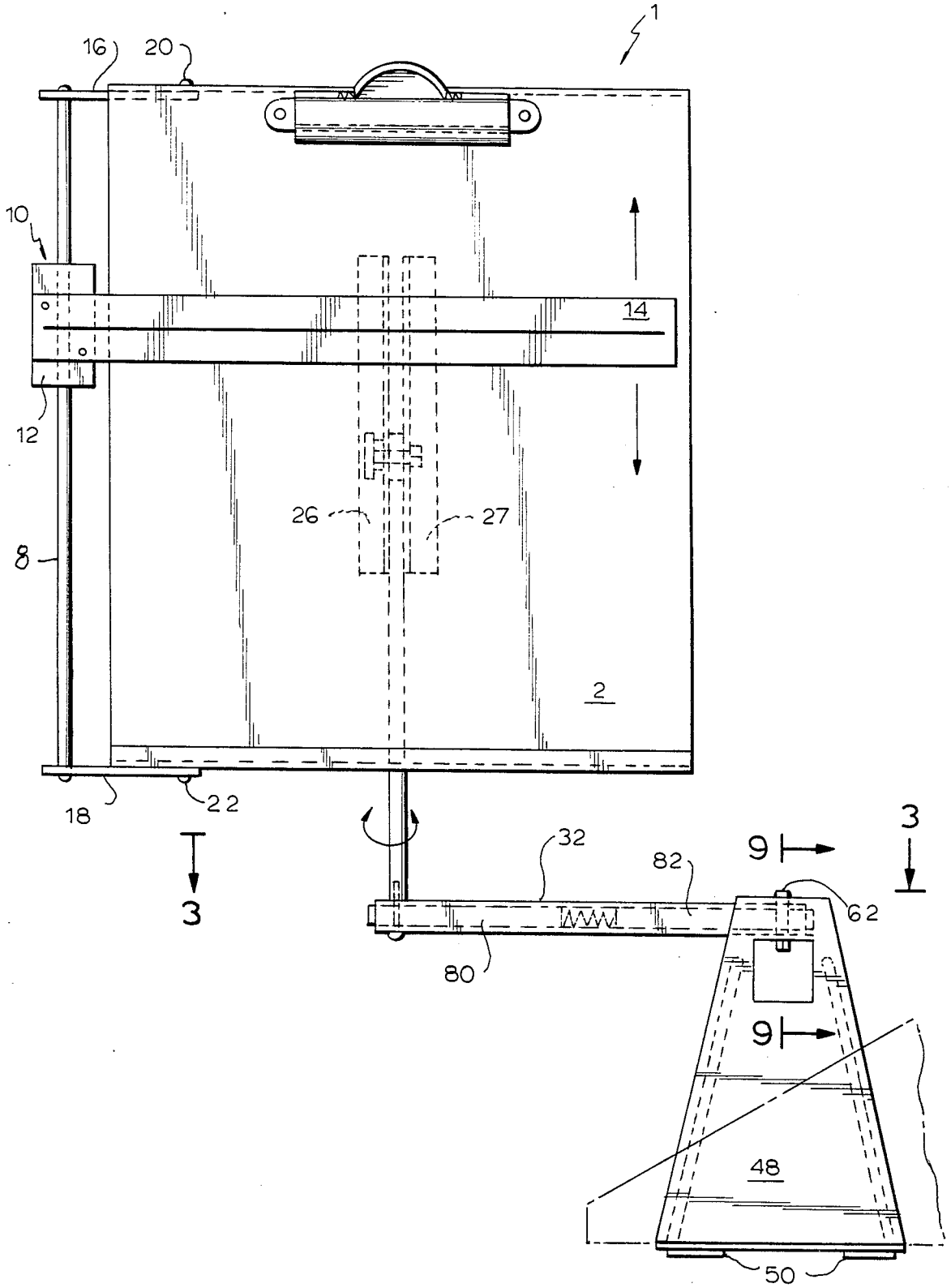
FIG. 1 is a front elevation view of a preferred embodiment of the apparatus of the invention.
Figures 2, 10:
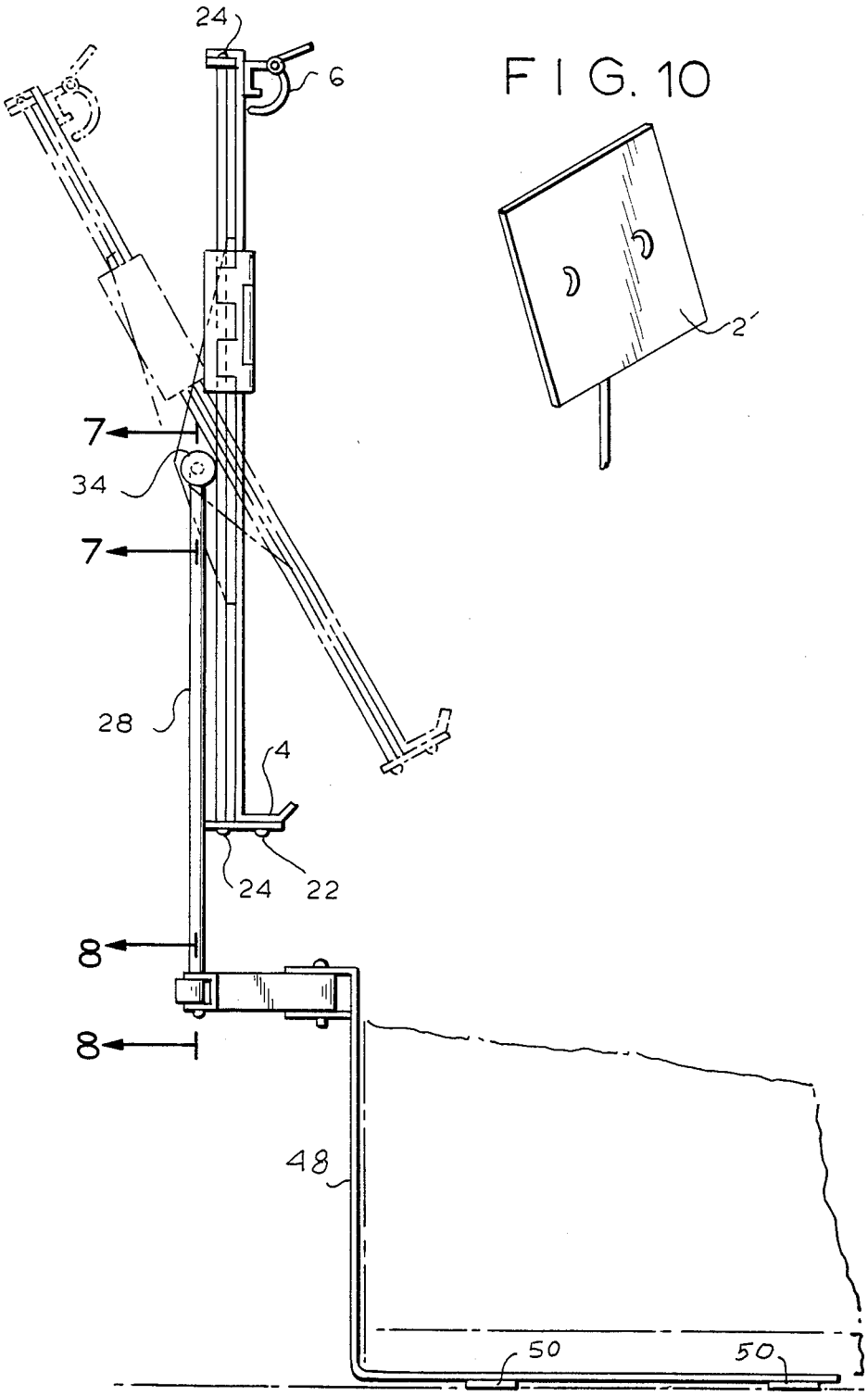
FIG. 2 is a side elevation view of the preferred embodiment of the apparatus of the invention.
FIG. 10 is a perspective view of a component adapted for use in an alternate preferred embodiment of the invention.

Referring now to FIGS. 1 and 2 of the drawings there is shown a copy holder 1 in accordance with the preferred embodiment of the invention which includes a rectangular shaped copy holder plate 2, which is made of aluminum in the preferred embodiment of the invention, with an outwardly extending ledge 4 at its bottom. The ledge 4 has a forward upturned edge. The work to be supported on the copy holder 1 is placed flat against the copy holder plate 2 and can have its bottom resting on the ledge 4. The ledge 4 is particularly useful where the work is a book in which case the upturned edge prevents the pages of the book from turning from their desired position. In order to support a page or pages of work which may not conveniently be stood up on the ledge 4 there is provided a conventional spring clip 6.

Mounted along one side of the copy holder plate 2 in parallel spaced relationship there is a guide strip rod 8 which is made from aluminum tubing in the preferred embodiment of the invention and is adapted to support a page sentence guide 10 slidably mounted thereon by means of a guide strip block 12 having a locking means the function of which is more fully explained below. Projecting horizontally from the guide strip block 12 is a horizontal guide strip 14, which is made of clear acrylic plexiglass in the preferred embodiment of the invention and extends toward the distal vertical edge of the copy holder plate 2 when viewed with reference to the guide strip rod 8.

The guide strip rod 8 is fixedly connected to the copy holder plate 2 by means of an upper straight guide strip rod support bracket 16 and a lower offset or S-shaped guide strip rod support bracket 18, each of which extends laterally from the copy holder plate 2 and in a direction generally parallel to its upper and lower horizontal edges. The upper edge of the copy holder plate 2 has a rearwardly orthogonally bent portion to which the straight upper guide strip rod support bracket 16 is held by a fastener 20. The lower guide strip rod support bracket 18 is held beneath the ledge 4 by a fastener 22. The fasteners 20 and 22 can be conventional rivets or bolts.

The guide strip rod 8 is attached to the upper guide strip rod support bracket 16 and the lower guide strip rod support bracket 18 by guide strip rod fastener bolts 24 which are passed through respective axially aligned apertures in the brackets 16 and 18 and threaded into respective axial bores at opposite ends of the guide strip rod 8.

Spaced parallel swing eye brackets 26 and 27 shown in phantom in FIG. 1 and in side view in FIG. 2 are preferably made of aluminum and welded to the central area of the rear or underside of the copy holder plate 2 for mounting the copy holder plate 2 on a swing eye rod 28 which is made from aluminum tubing in the preferred embodiment of the invention. The upper end of the swing eye rod 28 terminates in a swing eye 34 which has an aperture adapted to receive a carriage bolt 36. Referring now additionally to FIG. 7, at least one of the swing eye brackets 26 and 27 has a square aperture for receiving a square-in-cross-section projection on the underside of the head of the carriage bolt 36. The copy plate 2 is mounted with the apertures of the brackets 26 and 27 in axial alignment with the aperture in the swing eye on the rod 28 to receive the carriage bolt 36 thereby permitting the copy holder plate 2 to be rotated in a vertical plane relative to the swing eye rod 28. A nut 37 having a knurled gripping surface is threaded into the protruding end of the bolt 36 and can be tightened and loosened to selectively prevent and permit rotation of the copy holder plate 2 with respect to the swing eye rod 28 as best seen in FIGS. 2 and 7. The bolt 36 is passed through the swing eye at the end of the rod 8 which is wedged between the rear copy plate brackets 26 and 27 and is then threaded into the nut 37. A teflon washer 42 is preferably mounted on the bolt 36 to enhance retention of the copy holder plate 2 in the desired position.

As can be seen in FIGS. 1, 2, 3 and 8, the swing eye rod 28 has a hollow axial bore for receiving a lower swing eye rod fastener 30 for mounting the swing eye rod 28 on a spring holder extender arm 32 which is made of aluminum in the preferred embodiment of the invention. The spring holder arm 32 is hollow and rectangular in cross section. At each end of the arm 32, in the lower and upper surfaces thereof, there are axially aligned apertures. The upper surface aperture on the left end of the arm 32 as viewed in FIG. 1 is slightly larger in diameter than the than the outer diameter of the swing eye rod 28. The lower surface aperture on the left end of the arm 32 as viewed in FIG. 1 is slightly smaller in diameter than the than the outer diameter of the swing eye rod 28. Slidably disposed within the spring holder arm 32 are a left spring driven insert 80 and a right spring driven insert 82 each of which is preferably made of aluminum or another rigid metal or plastic and has a rectangular cross section slightly smaller than but symmetrical to the inner cross section of the spring holder arm 32. There is a vertical bore in each of the inserts 80 and 82, of diameter slightly larger than the outer diameter of the swing eye rod 28.

The swing eye rod 28 is inserted through the upper left aperture in the arm 32 and through the aperture in the insert 80 after which it abuts against the lower inner surface of the arm 32 as best seen in FIG. 8. The fastener bolt 30 and a washer 35 hold the swing eye rod 28 within the arm 32 but permit rotation of the rod 28 with respect to the arm 32.

A helical coil spring 84 urges the left spring driven insert 80 and right spring driven insert 82 mutually away from one another. The frictional force of the insert 80 against the rod 28 exerted by the force of the compressed helical spring 84 prevents inadvertent rotation of the rod 28. Hence the portion of the rod 28 disposed within the arm 32 and insert 80 acts as a pin with a cylindrical bearing surface about which there is controlled rotation between the copy holder plate 2 and the arm 32. Rotation is achieved by exertion of moderate manual force by the user.

Referring additionally to FIG. 9, the opposite end of the spring holder arm 32, is pivotally mounted between the dual flanges 46 and 47 of a base 48 which is made of aluminum in the preferred embodiment of the invention. The flanges 46 and 47 extend rearwardly in a horizontal plane from the rear vertical wall of the base 48 which has a flat horizontal lip adapted to be disposed underneath a typewriter, microcomputer or other desk top facility. The underside of the lip of the base 48 is provided with four feet 50 which are preferably made of rubber or other resilient frictional material so that when the weight of a typewriter or terminal bears down on the upper surface of the base 48 the copy holder 1 is held in place with stability.

Both the lip and upper extending wall of the base 48 are trapezoidal in shape for providing maximum stability and minimum interference with valuable desk space.

The end of the spring holder arm 32 which is disposed between the inner spaced parallel flanges 46 and 47 is journalled about the circumference of the elongated cylindrical head of a pin or bolt 62 which is passed through an aperture in the upper flange 46, the upper right aperture in the arm 32 and the bore in the insert 82 after which it abuts against the lower inner surface of the arm 32. A nut 60 is threaded onto the end of the pin 60 beneath the lower flange 47 to hold the pin 62 within the arm 32 and insert 82.

Thus it is seen that the bores in the inserts 80 and 82 are urged out of alignment with and against the circumferences of the cylindrical swing eye rod 28 and the pin 62 to provide sufficient friction so that the spring holder arm 32 can be rotated with respect both to the copy holder plate 2 and the base 48 only when sufficient force is exerted by the user to place the copy holder plate 2 in a desired disposition after which the copy holder plate 2 holds its position.

The construction and operation of the guide strip block 12 will now be described in greater detail with reference to FIGS. 4 and 5. The guide strip block 12 comprises a front guide strip block half 70 having alternate projections and recesses which intermesh with corresponding recesses and projections on a rear guide strip block half 72. The front and rear guide strip block halves 70 and 72 are made of clear acrylic plexiglass in the preferred embodiment of the invention. Extending through the projections in the front guide strip block half 70 and rear guide strip block half 72 are axially aligned bores all of which receive the guide strip rod 8. The inner diameters of the bores in the front guide strip block half 70 and rear guide strip block half 72 are slightly larger than the outer diameter of the guide strip rod 8 so that when all of the bores are in axial alignment, the guide strip block 12 is freely axially slidable along the guide strip rod 8 as well as rotatable about its axis. The front guide strip block half 70 is provided with a rectangular recess for receiving the horizontal strip 14 which is preferably held in place by horizontal strip fasteners 74 as best seen in FIGS. 4, 5 and 6.

Two compressed coil springs coil springs 76 urge the front guide strip block half 70 and rear guide strip block half 72 away from one another thereby disaligning the apertures of the projections in the front guide strip block half 70 with respect to the apertures in the projections of the rear guide strip block half 72 and exerting sufficient friction on the guide strip rod 8 to prevent relative movement of the guide strip block 12 with respect to the guide strip rod 8. In order to locate the horizontal strip 14 at any desired position on the copy holder plate 2, the front guide strip block half 70 and rear guide strip block half 72 are squeezed towards one another to align the axes of their apertures or bores thereby relieving the friction on the guide strip rod 8 and permitting the horizontal strip 14 to be axially slid in the vertical direction with respect to the copy holder plate 2 and also, if desired, to be pivoted upward and away from the surface of the copy holder plate 2 for insertion of materials to be viewed thereunder. The horizontal strip 14 has a guideline sentence line 15 engraved in or imprinted thereon.

Where it is desired to view materials other than normal page copy or a book, variations can be made to the copy holder plate 2. For example, as shown in FIG. 10, an alternate copy holder plate 2' can be substituted for the copy holder plate 2. The alternate copy holder plate 2' has rings which can be used to support flip cards for viewing on the copy holder 1.

It is to be appreciated that the foregoing is a description of the preferred embodiment of the invention to which alterations and variations can be made without departing from the spirit and scope of the invention which is set forth in the following claims. For example, the sentence page guide strip 14 can be fixedly mounted on the rod 8 which can in turn be slidable within one or more guide blocks 12 fixedly mounted with respect to the copy holder plate 2. Similarly, friction means like the inserts 80 or 82 and the spring 84 can be disposed in a housing fixedly connected to the copy holder plate 2 and/or base 48 to maintain friction against rotation with respect to the extender arm 32.

What is claimed is:

1. A copy holder comprising, first support means having a base, second support means comprising holder means for receiving copy to be viewed, extender means connected to said first support means and said second support means and maintaining said second support means in a position offset from said first support means, said first support means and said second support means being connected to said extender means to permit relative rotation therebetween only about axes substantially normal to the longitudinal axis of said extender means, first and second friction means movably mounted on said extender means, means for urging said first friction means toward said first pivotally connected support means for exerting a frictional force thereagainst to normally maintain said first pivotally connected support means in fixed position but permitting relative movement between said extender means and said first pivotally connected support means when a force greater than the frictional force exerted by said first friction means is applied between said extender means and said first pivotally connected support means, and for urging said second friction means toward said second pivotally connected support means for exerting a frictional force thereagainst to normally maintain said second pivotally connected support means in fixed position by permitting relative movement between said extender means and said second pivotally connected support means when a force greater than the frictional force exerted by said second friction means is applied between said extender means and said second pivotally connected support means.

2. A copy holder according to claim 1 wherein said urging means comprises a spring disposed between said first and second friction means.

3. A copy holder according to claim 2 wherein said first friction means comprises a first slidable insert urged into frictional contact with said first pivotally connected support means by said spring and said second friction means comprises a second slidable insert urged into frictional contact with said second pivotally connected support means by said spring.

4. A copy holder according to claim 3 further comprising first pin means connecting said extender means and said first pivotally connected support means, said first friction means being forced against said first pin means by said urging means and second pin means connecting said extender means and said second pivotally connected support means, said second friction means being forced against said second pin means by said urging means.

5. A copy holder according to claim 1 wherein said base comprises a lip disposed in a plane substantially parallel to the plane of rotation of said extender means.

6. A copy holder comprising, planar support means for receiving copy to be viewed, linear rigid guide rod means having a longitudinal axis parallel to the vertical axis of said support means, locking means releasably slidably mounted with respect to said guide rod means, wherein said locking means comprises first and second intermeshed halves with overlapping apertures receiving said guide rod means, the inner dimensions of said apertures being greater than the corresponding outer dimensions of said guide rod means, and means for urging said halves out of axial alignment and into frictional contact with said guide rod means for selectively preventing relative movement between said guide rod means and said locking means, said halves having surfaces adapted to be gripped for opposing the force of said urging means to relieve the friction on said guide rod means and permit relative movement between said guide rod means and said locking means only in a direction parallel to the vertical axis of said support means, and guide strip means mounted for translation in a plane parallel to the plane of said support means, said guide strip means being fixedly mounted on one of said locking means and said guide rod means, the other of said locking means and said guide rod means being fixedly mounted with respect to said planar support means for permitting translation of said guide strip means in a direction parallel to the longitudinal axis of said guide rod means.

7. A copy holder according to claim 6 wherein said urging means comprises a spring mounted to exert relative pressure between said halves of said locking means for disaligning the axes of said apertures.

* * * * *

UNITED STATES PATENT OFFICE

CERTIFICATE OF CORRECTION

Patent No. 4,582,285 Dated April 15, 1986

Inventor(s) Raymond P. Bello

It is certified that error appears in the above-identified patent and that said Letters Patent are hereby corrected as shown below:

Column 1, line 21, change "would" to --could--;

Column 3, line 30, change "into" to --onto--;

In Claim 1:

Column 6, line 4, change "by" to --but--.

Signed and Sealed this

*Sixteenth* Day of *September 1986*

[SEAL]

*Attest:*

DONALD J. QUIGG

*Attesting Officer*

*Commissioner of Patents and Trademarks*